US012723297B2

(12) United States Patent
Nakano et al.

(10) Patent No.: US 12,723,297 B2
(45) **Date of Patent: *Sep. 1, 2026**

(54) HOT WORK TOOL STEEL AND HOT WORK TOOL

(71) Applicant: Proterial, Ltd., Tokyo (JP)

(72) Inventors: Yousuke Nakano, Tokyo (JP); Shiho Fukumoto, Tokyo (JP); Kouta Kataoka, Tokyo (JP)

(73) Assignee: Proterial, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/325,994

(22) Filed: May 30, 2023

(65) Prior Publication Data

US 2023/0304135 A1 Sep. 28, 2023

Related U.S. Application Data

(63) Continuation of application No. 17/276,827, filed as application No. PCT/JP2019/018543 on May 9, 2019, now Pat. No. 12,312,665.

(30) Foreign Application Priority Data

Oct. 5, 2018 (JP) ..... 2018-190130

(51) Int. Cl.
*C22C 38/46* (2006.01)
*C21D 9/00* (2006.01)
(Continued)

(52) U.S. Cl.
CPC ..... *C22C 38/46* (2013.01); *C21D 9/00* (2013.01); *C22C 38/02* (2013.01); *C22C 38/04* (2013.01); *C22C 38/44* (2013.01)

(58) Field of Classification Search
CPC . B21C 25/02; B21J 13/02; C21D 1/18; C21D 1/58; C21D 1/613; C21D 6/002;
(Continued)

(56) References Cited

U.S. PATENT DOCUMENTS

2005/0161125 A1* 7/2005 Ozaki ..... C22C 38/04 148/334
2017/0342517 A1* 11/2017 Nakano ..... C21D 6/005

FOREIGN PATENT DOCUMENTS

CN 1445379 A * 10/2003
CN 105960475 A * 9/2016 ..... C21D 1/18
(Continued)

OTHER PUBLICATIONS

NPL: on-line translation of CN-1445379-A, Oct. 2003 (Year: 2003).*
(Continued)

*Primary Examiner* — Jie Yang
(74) *Attorney, Agent, or Firm* — JCIPRNET

(57) ABSTRACT

A hot work tool steel or hot work tool contains, in mass %, 0.25 to 0.45% of C, 0.1 to 0.4% of Si, 0.5 to 0.9% of Mn, 0.2 to 0.6% of Ni, 4.9 to 5.5% of Cr, 1.9 to 2.3% of Mo or 1/2W by itself or 1.9 to 2.3% of (Mo+1/2W) in combination, 0.6 to 0.9% of V, and a balance of Fe and impurities, and value A and value B calculated by the following Formula 1 and Formula 2 satisfy that value A is 6.00 or more and value B is 1.00 or less.

$$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

$$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo}) + 1/2W)) - 0.12(\%\ \text{V}) \quad \text{Formula 2}$$

8 Claims, 2 Drawing Sheets

(51) Int. Cl.

| | |
|---|---|
| ***C22C 38/02*** | (2006.01) |
| ***C22C 38/04*** | (2006.01) |
| ***C22C 38/44*** | (2006.01) |

(58) Field of Classification Search

CPC ..... C21D 6/004; C21D 7/13; C21D 8/005; C21D 9/00; C22C 38/02; C22C 38/04; C22C 38/22; C22C 38/24; C22C 38/44; C22C 38/46

See application file for complete search history.

(56) References Cited

FOREIGN PATENT DOCUMENTS

| | | | |
|---|---|---|---|
| EP | 2682491 | | 1/2014 |
| JP | 2018131654 A | * | 8/2018 |
| WO | 2007119721 | | 10/2007 |

OTHER PUBLICATIONS

NPL: on-line translation of CN-105960475-A, Sep. 2016 (Year: 2016).*

NPL: on-line translation of JP-2018131654 A, Aug. 2018 (Year: 2018).*

"Search Report of Europe Counterpart Application", issued on Jul. 20, 2023, p. 1-p. 9.

* cited by examiner

HOT WORK TOOL STEEL AND HOT WORK TOOL

CROSS REFERENCE TO RELATED APPLICATIONS

The present application is a Continuation Application of and claims the priority benefit of a prior U.S. application Ser. No. 17/276,827, filed on Mar. 17, 2021, now pending. The prior application is a 371 application of the international PCT application serial no. PCT/JP2019/018543, filed on May 9, 2019, which claims the priority benefit of Japan application no. 2018-190130, filed on Oct. 5, 2018. The entirety of each of the above-mentioned patent applications is hereby incorporated by reference herein and made a part of this specification.

BACKGROUND

Technical Field

The present invention relates to a hot work tool steel that is optimum for various hot work tools such as a press mold, a forging mold, a die-casting mold, and an extrusion tool, and relates to a hot work tool thereof.

Related Art

Because hot work tools are used in contact with high-temperature workpieces or hard workpieces, it is necessary for the hot work tools to have toughness that can withstand impact. Then, conventionally, as a hot work tool steel, for example, a SKD61 alloy tool steel that is a JIS steel grade has been used. Further, in response to recent demands for further improvement in toughness, an alloy tool steel having an improved composition of the SKD61 alloy tool steel has been proposed (patent literatures 1 and 2).

A hot work tool steel is usually manufactured in a manner that a material which is a steel ingot or a steel piece obtained by ingot-processing a steel ingot is used as a starting material, various hot working or heat treatments are performed on the starting material to obtain a predetermined steel material, and then the steel material is annealed. Then, the manufactured hot work tool steel is normally supplied to the manufacturer side of a hot work tool in an annealed state with low hardness, machined into the shape of the hot work tool, and then adjusted to a predetermined working hardness by quenching and tempering. Further, it is common to perform finish processing after adjusting to the working hardness. Then, the toughness of the hot work tool steel is evaluated in the quenched and tempered state (that is, a state corresponding to the hot work tool).

LITERATURE OF RELATED ART

Patent Literature

Patent literature 1: Japanese Patent Laid-Open No. 2006-104519

Patent literature 2: European Patent Application Publication No. 2194155 Specification SUMMARY

Problems to be Solved

However, when quenching and tempering the hot work tool steel, if the tool shape of the machined hot work tool steel is complicated, there is a problem that a "quenching crack" starting from a recessed part and the like is generated during quench cooling. Then, if the quenching crack is remarkable, it is difficult to remove the "crack" even in the finish processing thereafter, which causes a defect of the hot work tool. In this respect, there is room for consideration in achieving excellent toughness and quenching crack resistance in patent literatures 1 and 2.

The present invention provides a hot work tool steel having excellent toughness and quenching crack resistance, and to provide a hot work tool.

Means to Solve Problems

In view of the above problems, the present inventor conducted diligent research and found that by analyzing transformation behavior during quench cooling in detail, the hot work tool steel has a suitable component range in which the occurrence of the quenching crack can be suppressed and high toughness can be obtained.

That is, the present invention is a hot work tool steel containing, in mass %, 0.25 to 0.45% of C, 0.1 to 0.4% of Si, 0.5 to 0.9% of Mn, 0.2 to 0.6% (preferably, 0.2 to 0.5%) of Ni, 4.9 to 5.5% of Cr, 1.9 to 2.3% of Mo or 1/2W by itself or 1.9 to 2.3% of (Mo+1/2W) in combination, 0.6 to 0.9% of V, and a balance of Fe and impurities, and the relationship of the content of each element calculated by the following Formula 1 and Formula 2 satisfies that value A is 6.00 or more and value B is 1.00 or less. The content (mass %) of each element is shown in parentheses in Formulas 1 and 2.

$$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

$$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo} + 1/2W)) - 0.12(\%\ \text{V}) \quad \text{Formula 2}$$

Besides, the present invention is a hot work tool containing, in mass %, 0.25 to 0.45% of C, 0.1 to 0.4% of Si, 0.5 to 0.9% of Mn, 0.2 to 0.6% (preferably, 0.2 to 0.5%) of Ni, 4.9 to 5.5% of Cr, 1.9 to 2.3% of Mo or 1/2W by itself or 1.9 to 2.3% of (Mo+1/2W) in combination, 0.6 to 0.9% of V, and a balance of Fe and impurities, and the relationship of the content of each element calculated by the following Formula 1 and Formula 2 satisfies that value A is 6.00 or more and value B is 1.00 or less. The content (mass %) of each element is shown in parentheses in Formulas 1 and 2.

$$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

$$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo} + 1/2W)) - 0.12(\%\ \text{V}) \quad \text{Formula 2}$$

Effect

According to the present invention, it is possible to provide a hot work tool steel capable of suppressing a quenching crack during quenching and having excellent toughness after quenching and tempering, and a hot work tool thereof.

DESCRIPTION OF THE EMBODIMENTS

Figure 1:
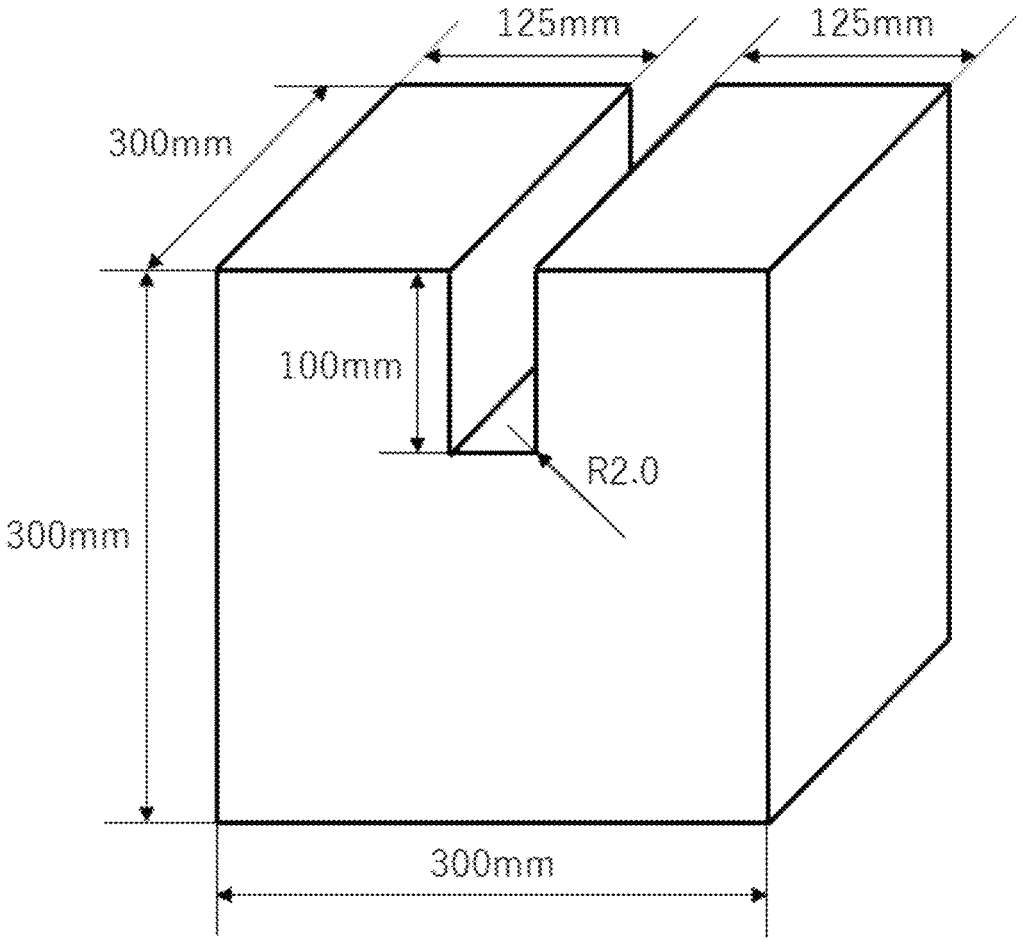
FIG. 1 is a diagram showing the shape of a test piece used in a quenching crack test of an example.

The present invention is characterized in that by adjusting the content of each element constituting the component composition of a hot work tool steel (or hot work tool) within an optimum and limited range, a hot work tool steel having excellent toughness and quenching crack resistance can be achieved. That is, by setting the component composition of a hot work tool steel to the above component composition, even if a manufacturing method of the hot work tool steel remains the same as the convention method and quenching and tempering conditions also remain the same as conventional conditions, it is possible to suppress a quenching crack during quench cooling and to impart high toughness after quenching and tempering.

The quenching is a process in which the hot work tool steel is heated to an austenite temperature range and cooled (cooled rapidly) to thereby transform the organization into martensite or bainite. Then, when the hot work tool steel is quenched, the timing of internal transformation occurs later than that of the surface, which causes an expansion difference at each position of the hot work tool steel. Then, if the tool shape of the hot work tool steel is complicated like the shape surface of various molds, stress is concentrated on a recessed part (corner part) of the hot work tool steel, and quenching crack is likely to occur.

Besides, in the hot work tool steel, in order to impart excellent toughness after quenching and tempering, elements such as Cr, Mn, Mo, W, Ni and the like that improve hardenability can be added, and then the amount of expansion at the time of transformation increases during quench cooling, resulting in more remarkable quenching crack.

Thus, in the present invention, by analyzing the above transformation behavior during quench cooling in detail, it has been found that the hot work tool steel has a suitable component range in which the occurrence of the quenching crack can be suppressed and high toughness can be obtained. Hereinafter, details of the component composition of the hot work tool steel (or hot work tool) of the present invention are described.

C: 0.25 to 0.45 Mass % (Hereinafter, Simply Referred to as "%")

C is a basic element of the hot work tool steel, a part of C is solid-dissolved in a base to impart strength, and a part of C forms carbides to improve wear resistance and seizure resistance. However, excessive addition of C acts to reduce hot strength. Then, the quenching crack during quench cooling is promoted. Therefore, C is set to 0.25 to 0.45%, preferably 0.30% or more, and more preferably 0.32% or more. Further, C is preferably 0.43% or less, and more preferably 0.40% or less.

Si: 0.1 to 0.4%

Si is an element which is a deoxidizing agent at the time of steelmaking and improves machinability. However, if there is too much Si, acicular bainite is generated in a quenching and tempering organization, and the toughness of a tool is lowered. Further, in the bainite organization during quench cooling, by suppressing the precipitation of cementite carbides, the precipitation/aggregation/enlargement of alloy carbides during tempering are indirectly promoted, and high temperature strength is lowered. Then, the quenching crack during quench cooling is promoted. Therefore, Si is set to 0.1 to 0.4%, preferably 0.15% or more, and more preferably 0.20% or more. Further, Si is preferably 0.35% or less, and more preferably 0.33% or less.

Mn: 0.5 to 0.9%

Mn is an element that improves hardenability, suppress the generation of ferrite and contributes to the improvement of toughness after quenching and tempering. In addition, Mn is an element effective in obtaining an appropriate quenching and tempering hardness. Furthermore, Mn is an element that shows a great effect on improving machinability if Mn is present in the organization in the form of nonmetallic inclusion MnS. However, if there is too much Mn, the viscosity of the base is increased and the machinability is lowered. Then, the quenching crack during quench cooling is promoted. Therefore, Mn is set to 0.5-0.9%, preferably 0.55% or more, and more preferably 0.85% or less.

Ni: 0 to 0.6%

Ni is an element that suppresses the generation of ferrite. Further, Ni is an element that imparts excellent hardenability to the hot work tool steel together with Cr, Mn, Mo, W and the like, and forms a martensite-based organization to effectively prevent deterioration of toughness even when the speed of quenching and cooling is moderate. Further, Ni is also an element that gives an essential toughness improvement effect of the base.

However, if there is too much Ni, the high temperature strength of the hot work tool is lowered. Further, the viscosity of the base is increased and the machinability is lowered. Then, the quenching crack during quench cooling is promoted. Therefore, in the present invention, it is important to strictly control the upper limit of Ni in order to ensure the quenching crack resistance of the hot work tool steel. Then, by satisfying value A and value B according to Formulas 1 and 2 described later, it is possible to impart excellent toughness to the hot work tool even if there is no Ni. Therefore, Ni is regulated to 0.6% or less, preferably 0.5% or less, more preferably 0.4% or less, and further preferably 0.3% or less. Then, when Ni is an impurity, the lower limit of Ni can be set to 0%, and the upper limit of Ni can be further set to 0.1% or 0.05%. However, the hot work tool steel of the present invention may also contain Ni if the value A and the value B according to Formulas 1 and 2 described later are satisfied. At this time, for example, the content of Ni can be set to 0.2% or more.

Cr: 4.9 to 5.5%

Cr is an element that improves hardenability and is effective in the improving toughness. Further, Cr is a basic element of the hot work tool steel that has an effect of forming a carbide in the organization to strengthen the base and improve wear resistance, and also contributes to the improvement of temper softening resistance and high temperature strength. However, excessive addition of Cr causes a decrease in high temperature strength. Then, the quenching crack during quench cooling is promoted. Therefore, Cr is set to 4.9-5.5%, preferably 5.0% or more, more preferably 5.1% or more, and further preferably 5.2% or more. In addition, Cr is preferably 5.45% or less, and more preferably 5.40% or less.

Mo or 1/2W by Itself or in Combination of (Mo+1/2W): 1.3 to 2.3%

Mo and W are elements that can be added alone or in combination in order to improve hardenability, improve toughness, and to impart strength and improve softening resistance by precipitating fine carbides by tempering. Because W has an atomic weight about twice that of Mo, it can be defined by (Mo+1/2W) (Obviously, only one of Mo and W may be added, or both of Mo and W may be added). However, if there is too much Mo or W, the machinability is lowered. Then, the quenching crack during quench cooling is promoted. Therefore, Mo and W are set to 1.3 to 2.3% in a relational expression of Mo equivalent weight of (Mo+1/2W), preferably 1.35% or more, more preferably 1.4% or more. In addition, Mo and W are preferably 2.2% or less in a relational expression of Mo equivalent weight of (Mo+1/2W), more preferably 2.15% or less, further preferably 2.1% or less.

Moreover, in the case of the present invention, because W is an expensive element, all of W can be replaced with Mo. At this time, Mo is set to 1.3 to 2.3% (the preferable range is the same as above). However, W may be contained as an impurity.

In the range of the Mo equivalent weight described above, particularly when further improvement of toughness is emphasized, preferably, the Mo equivalent weight is further set to 1.5% or more, more preferably 1.7% or more, further preferably 1.9% or more, and particularly preferably 2.0% or more. By adjusting the Mo equivalent weight to high value side, it acts to increase the value A calculated by Formula 1 described later.

On the other hand, in the range of the Mo equivalent weight described above, particularly when further improvement of quenching crack resistance is emphasized, preferably, the Mo equivalent weight is further set to 2.0% or less, more preferably 1.8% or less, further preferably 1.6% or less, and particularly preferably 1.5% or less. By adjusting the Mo equivalent weight to low value side, it acts to lower the value B calculated by Formula 2 described later.

V: 0.6 to 0.9%

V has an effect of forming carbides to strengthen the base and improve wear resistance. Further, V improves temper softening resistance and suppresses the enlargement of crystal particles to contribute to the improvement of toughness. Besides, V is an element that is effective in suppressing the quenching crack during quench cooling. However, if there is too much V, the machinability is lowered. Therefore, V is set to 0.6 to 0.9%, preferably 0.65% or more. In addition, V is preferably 0.85% or less, and more preferably 0.80% or less.

Value A calculated by Formula 1: 6.00 or more $$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

(The content (mass %) of each element is shown in parentheses.)

Then, in the present invention, it is important to control the value A calculated by the above Formula 1 to "6.00 or more" in the component composition of the hot work tool steel (or hot work tool) described above. That is, Formula 1 quantifies the influence degree of each element on exclusive "toughness" of a hot work tool steel. Besides, the "value A" obtained by Formula 1 is an index value showing the degree of "toughness" of a hot work tool steel having a certain component composition.

In the case of the hot work tool steel of the present invention, "Si, Mn, Ni, Cr, Mo, W and V" may be listed as elemental species that affect the toughness after quenching and tempering. Then, the present inventor has found that among these elemental species, Si acts on the decrease in toughness, and Mn, Ni, Cr, Mo, W and V act on the improvement of toughness. Then, the present inventor assigned a "positive" coefficient to Mn, Ni, Cr, Mo, W and V acting on the improvement of toughness and assigned a "negative" coefficient to Si acting on the decrease of toughness, determined the value of the coefficient (absolute value) according to the degree of action on the improvement or decrease of toughness for each coefficient, and thereby completed the above formula which can evaluate, by the component composition of the hot work tool steel, the balance between the content of each element that changes reciprocally and the toughness.

"Increasing" the value A calculated by the above Formula 1 by the above coefficient arrangement means improving the toughness of the hot work tool steel while minimizing the influence on other properties required for the hot tool steel, including quenching crack resistance described below. Besides, in the present invention, the above value A is set to "6.00 or more". Thereby, the toughness after quenching and tempering can be maintained at a high level by, for example, improving the hardenability during quench cooling. The value A is preferably "6.30 or more", more preferably "6.50 or more", further preferably "7.00 or more", and particularly preferably "7.30 or more".

In addition, the upper limit of the value A is not particularly required if the elements of Si, Mn, Ni, Cr, Mo, W and V constituting Formula 1 satisfy respective component ranges. Then, for example, the value A can be set to values such as "8.50", "8.30", "8.00" and "7.80" according to the relationship with value B described later.

Value B calculated by formula 2: 1.00 or less $$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo} + 1/2W)) - 0.12(\%\ \text{V}) \quad \text{Formula 2}$$

(The content (mass %) of each element is shown in parentheses.)

Then, in the present invention, it is important to control the value B calculated by the above formula 2 to "1.00 or less" in the component composition of the hot work tool steel (or hot work tool) described above. That is, Formula 2 quantifies the influence degree of each element on exclusive "quenching crack resistance" of a hot work tool steel. Besides, the "value B" obtained by Formula 2 is an index value showing the degree of "quenching crack resistance" of a hot work tool steel having a certain component composition.

In the case of the hot work tool steel of the present invention, "C, Si, Mn, Ni, Cr, Mo, W and V" may be listed as elemental species that affect the quenching crack during quench cooling. Then, the present inventor has found that among these elemental species, C, Si, Mn, Ni, Cr, Mo and W act on the decrease in quenching crack resistance, and V acts on the improvement in quenching crack resistance. Then, the present inventor assigned a "negative" coefficient to V acting on the improvement of quenching crack resistance and assigned a "positive" coefficient to C, Si, Mn, Ni, Cr, Mo and W acting on the decrease of quenching crack resistance, determined the value of the coefficient (absolute value) according to the degree of action on the improvement or decrease of quenching crack resistance for each coefficient, and thereby completed the above formula which can evaluate, by the component composition of the hot work tool steel, the balance between the content of each element that changes reciprocally and the quenching crack resistance.

"Reducing" the value B calculated by the above Formula 2 by the above coefficient arrangement means improving the quenching crack resistance of the hot work tool steel while minimizing the influence on other properties required for the hot tool steel, including the toughness described above. Besides, in the present invention, the above value B is set to "1.00 or less". In particular, it is necessary to strictly control the value B. Thereby, it is possible to cope with the expansion difference generated in the hot work tool steel during quench cooling and to suppress the quenching crack during quench cooling.

In addition, the lower limit of the value B is not particularly required if the elements of C, Si, Mn, Ni, Cr, Mo, W and V constituting Formula 2 satisfy respective component ranges. Then, for example, the value B can be set to values such as "0.70", "0.75", "0.80", "0.85" and "0.90" according to the relationship with the value A described above.

The quenching and tempering temperatures, which are related to effects of "suppression of the quenching crack during quench cooling" and "improvement of toughness after quenching and tempering" of the present invention, are different depending on the component composition, target hardness, and the like of the material, but the quenching temperature is preferably about 1000 to 1100° C., and the tempering temperature is preferably about 500 to 650° C.

Then, preferably, the quenching and tempering hardness is set to 50HRC or less, preferably 40 to 50HRC, more preferably 41HRC or more, and further preferably 42HRC or more. In addition, the quenching and tempering hardness is more preferably 48HRC or less, and further preferably 46HRC or less.

Example

A steel ingot having the component composition of table 1 was melted using a 10t arc melting furnace. After a heat equalizing treatment (soaking) was performed on the steel ingot to keep the it at a temperature of 1200° C. or more, hot forging was performed between 1000 to 1250° C. on the steel ingot, finished in a steel material with a dimension exceeding approximately a thickness of 300 mm x a width of 400 mm. Then, the steel material was annealed at 850 to 900° C. to prepare hot work tool steels of samples 1 to 5 (example of the present invention) and 11, 12 and 13 (comparison example). Table 1 also shows the value A and the value B obtained by Formula 1 and Formula 2 of the present invention.

TABLE 1

(mass %)

| Sample | C | Si | Mn | Ni | Cr | Mo | W | V | Fe ※1 | value A ※2 | value B ※3 | Note |
|---|---|---|---|---|---|---|---|---|---|---|---|---|
| 1 | 0.37 | 0.31 | 0.60 | 0.01 | 5.32 | 1.40 | <0.01 | 0.75 | Bal. | 6.55 | 0.96 | Example of the present invention |
| 2 | 0.34 | 0.31 | 0.78 | 0.30 | 5.25 | 2.10 | <0.01 | 0.68 | Bal. | 7.53 | 0.98 | |
| 3 | 0.37 | 0.26 | 0.59 | 0.14 | 5.24 | 1.38 | <0.01 | 0.76 | Bal. | 6.66 | 0.97 | |
| 4 | 0.35 | 0.29 | 0.79 | 0.31 | 5.21 | 2.05 | <0.01 | 0.72 | Bal. | 7.52 | 0.99 | |
| 5 | 0.36 | 0.33 | 0.62 | 0.09 | 5.39 | 1.45 | 0.02 | 0.83 | Bal. | 6.79 | 0.95 | |
| 11 | 0.37 | 1.00 | 0.45 | 0.01 | 5.15 | 1.25 | <0.01 | 0.85 | Bal. | 5.63 | 0.95 | Comparison example |
| 12 | 0.37 | 0.25 | 0.60 | 0.60 | 5.15 | 2.20 | <0.01 | 0.80 | Bal. | 7.70 | 1.03 | |
| 13 | 0.37 | 0.40 | 0.60 | 0.01 | 5.15 | 2.70 | <0.01 | 0.60 | Bal. | 7.07 | 1.02 | |

※1: including impurities

※2: −0.7(% Si) + 1.5(% Mn) + 1.3(% Ni) + 0.9(% Cr) + 0.6(% (Mo + ½W)) + 0.3(% V)

※3: 1.9(% C) + 0.043(% Si) + 0.12(% Mn) + 0.09(% Ni) + 0.042(% Cr) + 0.03(% (Mo + ½W)) − 0.12(% V)

The content (mass %) of each element is shown in parentheses.

<Quenching Crack Test>

A block having a length of 300 mm, a width of 300 mm, and a height of 300 mm was collected from the sample, and a groove having a width of 50 mm and a depth of 100 mm was machined on one surface of the block to prepare a concave test piece (FIG. 1). The corner shape of the recessed part (groove bottom) was finished with a radius of curvature of 2.0R. In addition, as for samples 1, 3 and 5, test pieces having a recessed part with a radius of curvature of 1.5R were also prepared. The test piece was quenched at a quenching temperature of 1020 to 1030° C. The quench cooling was performed by oil cooling, and the test piece was pulled up from the oil when the temperature at the center of the test piece reached 200 to 250° C. Then, the process directly shifted to heating to the tempering temperature (500 to 650° C.), and after tempering with a target hardness of 43HRC, a penetrant inspection test (dye check) was performed on the surface of the test piece corresponding to the hot work tool to confirm whether or not there was a quenching crack at the corner of the groove bottom.

<Charpy Impact Test>

A Charpy impact test piece (S-T direction, 2 mm U notch) was collected from the sample and was quenched and tempered. The quenching was performed at a quenching temperature of 1030° C., and the quench cooling was performed with pressurized gas. At this time, a central part of the actual hot work tool steel having a large size was assumed and cooled at a slow cooling rate at which time required for cooling from the quenching temperature (1030° C.) to a temperature (525° C.) of [quenching temperature+ room temperature (20° C.)]/2 (so-called half cooling time) was about 90 minutes. Then, after quenching, the tempering was performed at various temperatures among 500 to 650° C. to adjust the target hardness to 43HRC, which corresponds to the hot work tool, and after finish processing, the Charpy impact test was conducted.

<Evaluation of Quenching Crack Resistance and Toughness>

Figure 2:
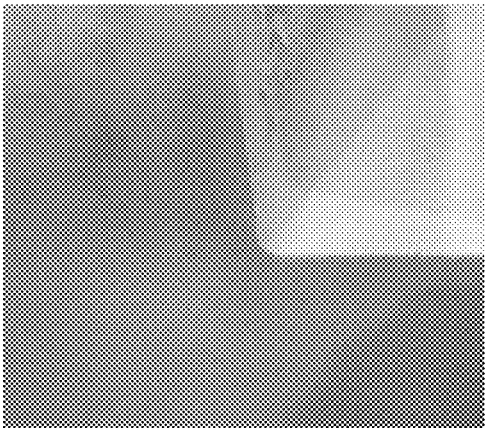
FIG. 2 is a drawing-substituting photograph showing a corner of a groove bottom of a test piece of an example of the present invention after the quenching crack test of the example is performed.

Results of the quenching crack test and the Charpy impact test are shown in table 2. In samples 1 to 5 of the examples of the present invention, Charpy impact values of 30 J/cm$^2$ or more were obtained. In particular, in samples 2 and 4, Charpy impact values of 40 J/cm$^2$ or more were obtained. Further, in samples 1 to 5 of the examples of the present invention, no quenching crack was confirmed at the corner of the groove bottom (FIG. 2). As for samples 1, 3 and 5, no quenching crack was confirmed even in the test piece having the recessed part with a radius of curvature of 1.5R.

Figure 3:
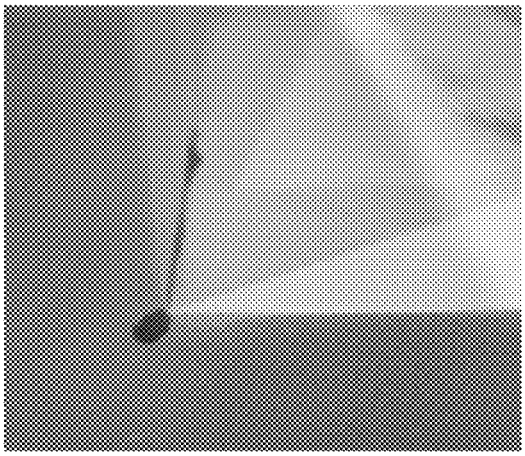
FIG. 3 is a drawing-substituting photograph showing a corner of a groove bottom of a test piece of a comparison example after the quenching crack test of the example is performed.

On the other hand, sample 11 of the comparison example had a small value A and did not achieve a Charpy impact value of 30 J/cm$^2$ or more. Further, sample 13 of the comparison example had a large value B and a quenching crack was generated at the corner of the groove bottom. The same applies to sample 12 of the comparison example. In sample 12, the content of each element satisfied the present invention, but a quenching crack was generated at the corner of the groove bottom (FIG. 3; the streak is the penetrant).

TABLE 2

| Sample | Value A | Value B | Charpy impact value (J/cm$^2$) | Quenching crack | Note |
|---|---|---|---|---|---|
| 1 | 6.55 | 0.96 | 36.6 | None | Example of the present invention |
| 2 | 7.53 | 0.98 | 44.3 | None | |
| 3 | 6.66 | 0.97 | 34.3 | None | |
| 4 | 7.52 | 0.99 | 40.0 | None | |
| 5 | 6.79 | 0.95 | 36.5 | None | |
| 11 | 5.63 | 0.95 | 25.9 | None | Comparison example |
| 12 | 7.70 | 1.03 | 44.9 | Yes | |
| 13 | 7.07 | 1.02 | 41.7 | Yes | |

What is claimed is:

1. A hot work tool steel containing, in mass %, 0.25 to 0.45% of C, 0.1 to 0.33% of Si, 0.5 to 0.9% of Mn, 0.2 to 0.4% of Ni, 5.0 to 5.45% of Cr, 1.9to 2.3% of Mo or 1/2W by itself or 1.9 to 2.3% of (Mo+1/2W) in combination, 0.6 to 0.9% of V, and a balance of Fe and impurities, wherein a Charpy impact value of a Charpy impact test piece of the hot work tool steel in S-T direction with 2 mm U notch and a target hardness of 43HRC is 40 J/cm$^2$ or more; and a relationship of the content of each element calculated by the following Formula 1and Formula 2 satisfies that value A is 7.00 or more and 8.66 or less, and value B is 1.00 or less, $$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

$$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo} + 1/2W)) - 0.12(\%\ \text{V}) \quad \text{Formula 2}$$

wherein the content in mass % of each element is shown in parentheses.

2. The hot work tool steel according to claim 1, wherein there is 0.2-0.3% of Ni in mass %.

3. The hot work tool steel according to claim 1, wherein the value A is 7.00 or more and 8.50 or less.

4. The hot work tool steel according to claim 1, wherein there is 5.1 to 5.40% of Cr in mass %.

5. A hot work tool containing, in mass %, 0.25 to 0.45% of C, 0.1 to 0.33% of Si, 0.5 to 0.9% of Mn, 0.2 to 0.4% of Ni, 5.0 to 5.45% of Cr, 1.9 to 2.3% of Mo or 1/2W by itself or 1.9 to 2.3% of (Mo+1/2W) in combination, 0.6 to 0.9% of V, and a balance of Fe and impurities, wherein a Charpy impact value of a Charpy impact test piece of the hot work tool in S-T direction with 2 mm U notch and a target hardness of 43HRC is 40 J/cm$^2$ or more; and a relationship of the content of each element calculated by the following Formula 1and Formula 2 satisfies that value A is 7.00 or more and 8.66 or less, and value B is 1.00 or less, $$\text{Value } A = -0.7(\%\ \text{Si}) + 1.5(\%\ \text{Mn}) + 1.3(\%\ \text{Ni}) + 0.9(\%\ \text{Cr}) + 0.6(\%\ (\text{Mo} + 1/2W)) + 0.3(\%\ \text{V}) \quad \text{Formula 1}$$

$$\text{Value } B = 1.9(\%\ \text{C}) + 0.043(\%\ \text{Si}) + 0.12(\%\ \text{Mn}) + 0.09(\%\ \text{Ni}) + 0.042(\%\ \text{Cr}) + 0.03(\%\ (\text{Mo} + 1/2W)) - 0.12(\%\ \text{V}) \quad \text{Formula 2}$$

wherein the content in mass % of each element is shown in parentheses.

6. The hot work tool according to claim 5, wherein there is 0.2-0.3% of Ni in mass %.

7. The hot work tool according to claim 5, wherein the value A is 7.00 or more and 8.50 or less.

8. The hot work tool according to claim 5, wherein there is 5.1 to 5.40% of Cr in mass %.

* * * * *